US011583017B2

(12) United States Patent
Wurapa et al.

(10) Patent No.: US 11,583,017 B2
(45) Date of Patent: Feb. 21, 2023

(54) AMBIDEXTROUS HAND COMPRESSION THERAPEUTIC GLOVE FOR REMEDIATING INFLAMMATION, SWELLING, AND PAIN

(71) Applicant: Brownmed, Inc., Boston, MA (US)

(72) Inventors: Raymond K. Wurapa, Blacklick, OH (US); Brandon Rodriguez, Westwood, MA (US); Courteney DiDomenico, Medford, MA (US)

(73) Assignee: Brownmed, Inc., Boston, MA (US)

( * ) Notice: Subject to any disclaimer, the term of this patent is extended or adjusted under 35 U.S.C. 154(b) by 129 days.

(21) Appl. No.: 16/948,482

(22) Filed: Sep. 21, 2020

(65) Prior Publication Data

US 2022/0087345 A1 Mar. 24, 2022

(51) Int. Cl.
*A41D 19/00* (2006.01)
*A41D 19/015* (2006.01)

(52) U.S. Cl.
CPC ... *A41D 19/01582* (2013.01); *A41D 19/0003* (2013.01); *A41D 2400/32* (2013.01)

(58) Field of Classification Search
CPC ..... A41D 19/0003; A41D 19/01582; A41D 2400/32
See application file for complete search history.

(56) References Cited

U.S. PATENT DOCUMENTS

| | | | | |
|---|---|---|---|---|
| 5,415,624 | A | 5/1995 | Williams | |
| 2002/0029401 | A1* | 3/2002 | McEvoy | A41D 19/01582 2/161.7 |
| 2003/0109910 | A1 | 6/2003 | Lachenbruch et al. | |
| 2005/0273030 | A1* | 12/2005 | Koby | A61F 5/0118 602/21 |
| 2011/0087145 | A1* | 4/2011 | Farrow | A61F 5/0118 602/22 |
| 2016/0309815 | A1* | 10/2016 | Hull | A41D 19/0058 |

* cited by examiner

*Primary Examiner* — Tajash D Patel
(74) *Attorney, Agent, or Firm* — McKee, Voorhees & Sease, PLC

(57) ABSTRACT

Anatomically contoured ambidextrous compression glove particularly for the hand, form fitting to the tissue to ensure targeted delivery of therapeutic treatment to specific tissue, and yet remain stably affixed without pinching or binding, and allow for motion and use of the tissue while delivering targeted therapeutic treatment.

6 Claims, 4 Drawing Sheets

AMBIDEXTROUS HAND COMPRESSION THERAPEUTIC GLOVE FOR REMEDIATING INFLAMMATION, SWELLING, AND PAIN

FIELD OF THE INVENTION

The invention relates generally to a reversible assistive device (compression glove) for remediating one or more of inflammation, swelling and pain, in particular in the hand and wrist. The glove is particularly suitable for continuous wear under some circumstances and is adaptable for providing a plurality of modalities of therapy and is ambidextrous (useable on either hand).

BACKGROUND OF THE INVENTION

Pain associated with inflamed joints affects a wide swath of the population. Arthritic pain is particularly problematic because it is chronic and persistent and requires significant ongoing care. Arthritis is a common condition affecting more than 50 million adults in the United States. The hands and wrists are frequently involved, with symptoms including swelling, pain, and joint stiffness. In addition, there are approximately 3.5 million hand and wrist injuries annually in the United States seen at emergency facilities. Many of these injuries are minor, and mainly require cyclic cold application, as well as immobilization and elevation to minimize swelling/tissue inflammation and expedite healing.

Generally, in the context of joint, bone and associated soft tissue discomfort, a wide variety of non-surgical treatments abound beyond drugs and topical medications. Therapy involving application of heat or cooling, as described above, can play a significant role in helping manage these symptoms for acute care post-injury and post-surgery, and for chronic conditions, such as arthritis. Assistive devices in the form of pads and packs deliver warmth or cooling to provide temporary relief to painful and swollen joints. But these treatments can be bulky and cumbersome, are often prone to leakages, and typically cannot be readily held in place to allow the user freedom to engage in typical day-to-day, professional, and recreational activities. This is particularly the case with treatments for extremities such as the hands and wrists. Moreover, few if any such gloves are reversible, that useful for either hand.

There are examples in the art of devices for delivery of cooling or warmth that are adapted to be affixed to or donned by a user, such as mitts and mittens. But these assistive devices typically suffer from many of the same challenges of pads and packs in that they are bulky and cumbersome, and though they may be held in place by virtue of fitting over the tissue, such as the hand, they generally interfere with the ability of the user to engage in some or all of their typical activities while the tissue is being treated. Further, many devices, including those that can be donned, do not precisely and effectively direct soothing treatment to the target tissue due to the loose and non-specific shape and fit. Further still, many devices are formed with materials that are insulating, causing generalized heating of the entire tissue, when only certain areas are intended for delivery of the therapeutic treatment. And some devices, particularly those that are designed to be close fitting, can actually increase discomfort by causing fatigue and possible reduction of blood flow due to poor fit and associated pinching or binding.

These described disadvantages, among others, often discourage use of the assistive devices, resulting in unresolved pain and perhaps slow healing and further deterioration. Thus, the devices in the art may, as a result of their construction or design, be rejected by a user, may fail to provide the desired therapeutic benefit, and also may create the possibility of exacerbating discomfort and pain. Accordingly, there is a need in the art for compression gloves, particularly for extremities such as the hand, which are form fitting to the tissue to ensure targeted delivery of therapeutic treatment to specific tissue, that will remain stably affixed without pinching or binding, and allow for motion and use of the hand parts while delivery targeted therapeutic treatment to either hand.

SUMMARY OF THE INVENTION

In a first exemplary embodiment, therapeutic compression gloves include flexible sleeves that include one or more integrated pads, where the pads are positioned to direct therapy to isolated portions, such as specific joints of the thumb, hand or wrists, or specific fingers, or specific knuckles, or combinations of these. And in other embodiments, the pads may be shaped and contoured to cover all or optionally only a portion of the volar, dorsal, medial, and lateral surfaces of the anatomy.

In another exemplary embodiment, the integrated pad delivers therapeutic treatment, such as thermal treatment, and more particularly heating, cooling, and combinations thereof to strategic locations. Thus, in some embodiments, the therapeutic pad may deliver either heat or cold therapy to areas of specific concern, i.e. hand, wrist, fingers, or knuckles, as selected. An "integrated pad" as used herein differs from a removable insert, in that its location with respect to the areas of the hand anatomy of the glove wearer is fixed precisely because it is an integral part of the whole of the glove.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Feature and advantages of the general invention concepts will become apparent from the following description made with reference to the accompanying drawings, including drawings represented herein in the attached set of figures, of which the following is a brief description.

Figure 1:
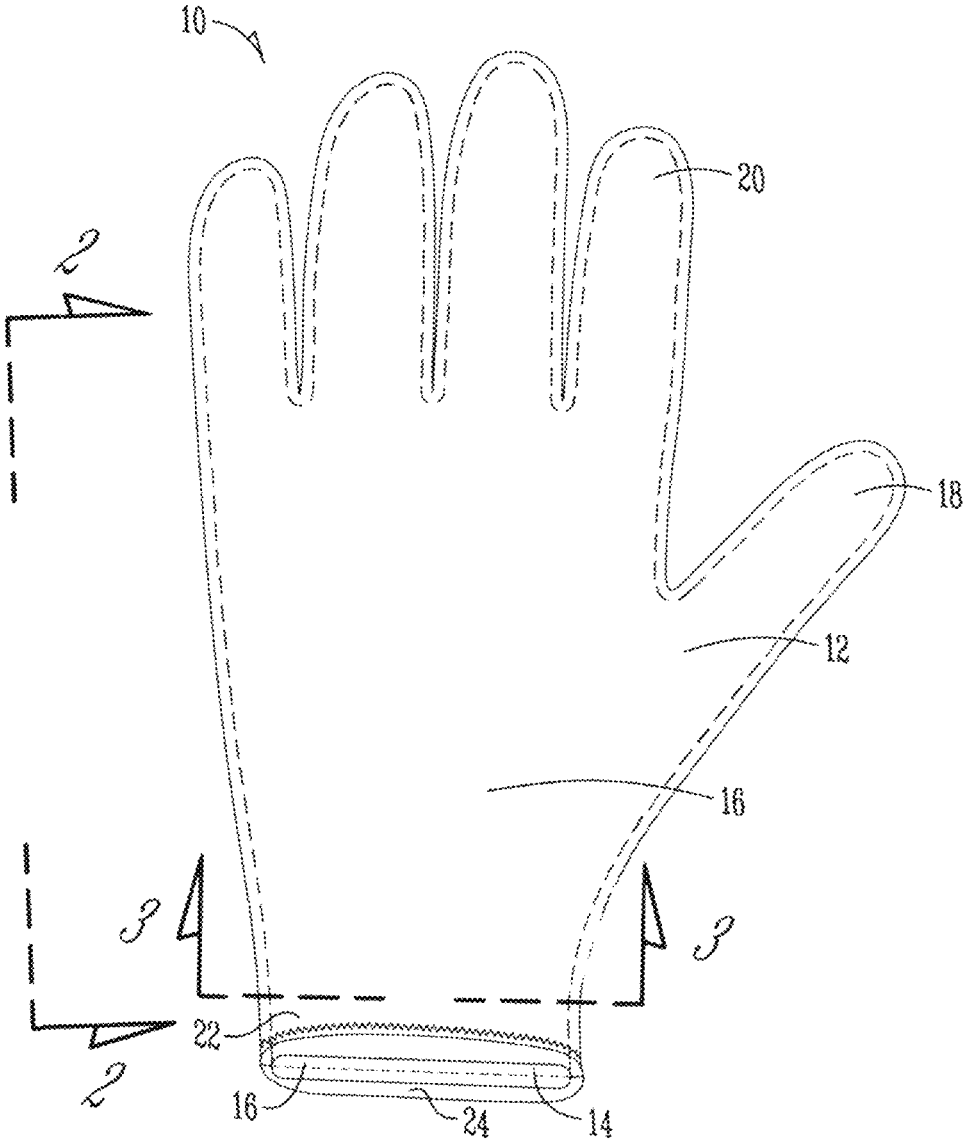
FIG. 1 shows in perspective a therapeutic compression glove according to one embodiment.

Features and advantages of the general inventive concepts will become apparent from the following description made with references to the accompanying drawings.

DETAILED DESCRIPTION OF PREFERRED EMBODIMENTS

The description provides exemplary embodiments in accordance with the general inventive concepts and is not intended to limit the scope of the invention in any way. Indeed, the invention as described in the specification is broader than and unlimited by the exemplary embodiments set forth herein, and the terms used herein have their full and ordinary meaning unless otherwise defined.

The general inventive concepts will now be described with occasional reference to the exemplary embodiments of the invention. Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts.

As used herein, the singular forms of "a", "an", and "the" are intended to include the plural forms as well, unless the context clearly indicates otherwise. Anatomical references as used herein are intended to have the standard meaning for such terms as understood in the medical community. For example, the application may include reference to the following terms: volar (the front, as opposed to the back); dorsal (the back or behind, as opposed to the front); inferior (below, as opposed to superior); superior (above, as opposed to inferior); lateral (toward the left or right side of the body, as opposed to toward the middle); medial (in or toward the middle or inside of the body, as opposed to away from the middle toward the left or right); proximal (toward the body, as opposed to toward the ends, such as of the fingers and hands); and distal (away from the body, as opposed to towards the body, and towards the ends).

This invention is described herein in relation to amelioration of swelling and pain in joints, including in particular, arthritic conditions of the hand. One skilled in the art will appreciate that the assistive devices and the methods of use thereof, as described herein, can be directed without undue adaption to applications that include, but are not limited to, remediation of conditions in other tissues and other sites of the body, and amelioration of discomfort associated with a variety of causes, such as fatigue, injury, and post-surgical conditions and the like.

Generally, in accordance with the embodiments described herein and depicted in the drawings, the invention is directed in various aspects to a compression therapeutic glove and components, and methods of use for the relief of joint and soft tissue discomfort.

As described herein, the compression glove includes an anatomically contoured flexible compression sleeve that slips over or is fitted to and closely conforms to the hand, wrist, and fingers to be treated, and one or a combination of an integral therapeutic pads that comprise one or more of heating, cooling, and other therapeutic applications. Thus, in such embodiments that include therapeutic pads for delivery of thermal therapeutic applications, the therapeutic pad materials include, but are not limited to, thermal energy storage material, the therapeutic material positioned for targeted treatment of the tissue.

In some embodiments, the compression glove further includes at least one or a plurality of inserts that are positioned in or on the flexible sleeve in targeted areas of the anatomy to be treated. In some such embodiments, the inserts can further include on or more retaining elements for retaining therapeutic material.

Figure 2:
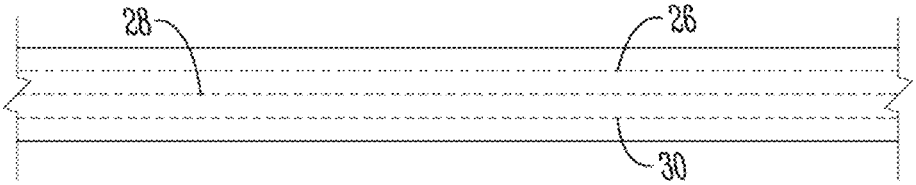
FIG. 2 shows a side view of the glove of FIG. 1 from line 2-2.
Figure 3:
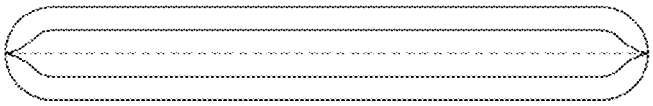
FIG. 3 shows a cross sectional view of the glove of FIG. 1 along line 3-3.
Figure 4:
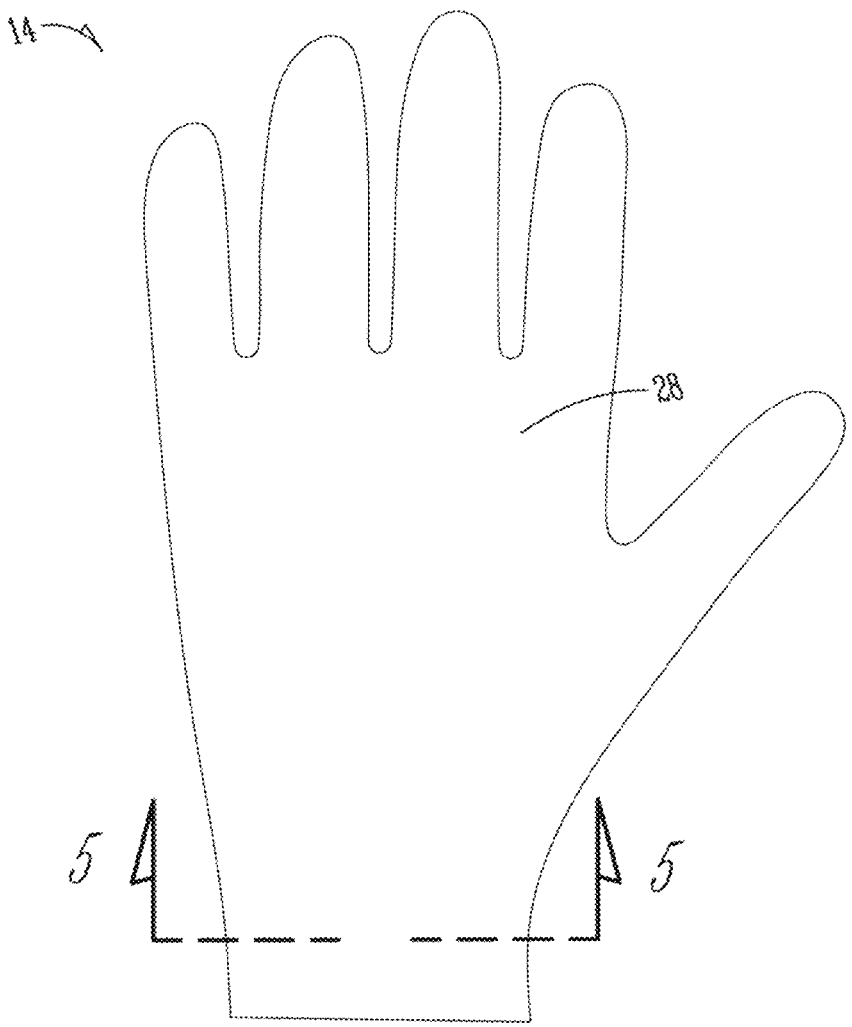
FIG. 4 shows the integral pad before being sewn in the glove.
Figure 5:
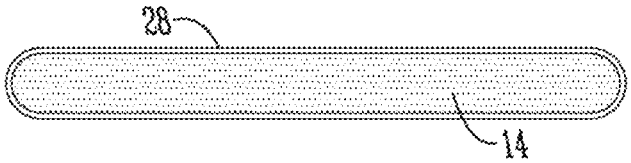
FIG. 5 shows a cross section of the integral pad of FIG. 4 along line 5-5.

Referring now to the drawings, each of FIGS. 1-3 show the compression glove and its integral therapeutic pad while FIGS. 4 and 5 show the details of the sewn in integral pad.

Referring again to the drawings, as depicted, each of these exemplary embodiments has a profile that is shaped generally like a human hand, with thumb, finger, hand, and wrist regions. Referring specifically to FIG. 1, the depicted embodiment of compression glove 10 having an outer flexible sleeve 12 and at least one integral therapeutic pad 14, itself covered with its own sleeve 16. The glove 10 and the therapeutic pad 14 both have a hand region 16, a thumb region 18, a finger region 20 and a wrist region 22. The compression glove 10 is constructed and configured to fit either the left or the right hand. As illustrated, the integral pad 14 is inserted in the inner cavity 24 of glove 10. Integral pad 14 is sewn along sew lines 26, 28 and 30 on each lateral side of glove 10. As a result, the glove can be worn on either hand by inserting the hand on top of pad 14 and into the glove on either side of integral pad 14.

In accordance with the various embodiments, the glove is therefore adapted to features to more precisely accommodate either the hand of a user. Thus, the purchaser can buy a single therapeutic glove and be equipped to address arthritic pain in either hand depending on which hand is inserted into the glove 10 cavity 24, above the integral pad 14.

In accordance with some embodiments, the glove is adapted with expansion features that allow expansion to accommodate the size and/or motion of the user's hand. In some examples, these expansion features include one or more of gussets, baffles, crinkled or accordion pleats, and elastic material. The options are well known in most common gloves and can also be applied to compression gloves.

As shown in the drawings of FIGS. 4 and 5, the integral pad 14 is adapted to conform to anatomical areas that include more or fewer specific anatomical structures of the hand. Thus, as shown in the drawings, for example, FIG. 1, glove 10 with integral, inner pad 14 sewn in, is adapted to fit to essentially the full anatomical structure, of the hand and wrist, and thus also fit anatomical structures corresponding to the thumb region 18, finger region 20, hand region 16, and wrist region 22. In other embodiments, of course, a device may be adapted for pad 14 to fit the individual fingers, in addition to the thumb, or some subsets thereof. Further, in some embodiments, the assistive devices may be adapted to fit or cover only a portion of the hand, for example, covering only the portions intended for therapeutic treatment and not covering other structures of the hand, for example leaving the knuckles free from the hot/cold therapy pad.

According to some embodiments, the therapeutic pad 14 is supported by the flexible sleeve to direct therapeutic treatment to the targeted areas and are held in place by portions of the flexible sleeve 12 compressing the hand against integral pad 14. Thus, the therapeutic pad targets one of the wearer's hands and allows the user to engage in daily activities.

The flexible sleeve compression glove 10 provides at least localized compression to all or targeted portions of the covered anatomy, which compression may or may not be co-localized with a therapeutic pad. In some embodiments, the compression helps control or decrease swelling, or enhance contact of the therapeutic pad with the targeted tissue, or both.

It will be appreciated that some or all of the pads are integrated with the flexible sleeve and are not removable. According to such embodiments, the pads may be formed partially or entirely of the same material as the flexible sleeve. Thus, in some examples, the flexible sleeve and one or more integrated pads are formed of a material that is flexible and breathable, and can be treated to enable retention and delivery of thermal treatment, such as heating or cooling or both, as further described herein below in relation to the pads. The fixed location pad assure therapy will address the targeted areas of the hand where therapy is needed.

Pad and Therapeutic Material

In an exemplary embodiment, the therapeutic material is selected from a fluid or particular solid that is conforming and flowable, to allow optimal conforming to the target tissue. In some embodiments, a therapeutic pad is fitted with a flexible sleeve to be in direct contact with the targeted tissue to closely conform to and maximize the direction of thermal benefit to the tissue. In some representative examples, the thermal material may include one or more of gels, ceramic beads, plastic beads, sand and other flowable or formable materials, and heat retaining materials selected from phase change materials (PCMs), for example, sodium polyacrylates, salt hydrates, paraffins, water, vegetable based PCMs and combinations of these. In some embodiments, the PCMs may be coated onto or formed into flowable fluids or particulates, or combinations of these. PCMs are materials that use phase changes (e.g. solidifying/liquifying) to absorb or release relatively large amounts of latent heat as relatively constant temperature.

In some embodiments, the therapeutic material may be thermally adjusted, whereby the material is either heated or cooled, using any of a variety of methods. In some examples, the material may be cooled using a convention freezer, or exposure to or immersion in a material such as ice, dry ice, cold water, liquid nitrogen, and the like. And in some examples, the material may be cooled using a microwave, a convention oven, immersion in hot liquid such as hot water and the like, or by application of electrical energy or exposure to another electrified heat generator.

In some embodiments, the pads that are suited for delivery of heat are adapted with features that enable application of electrical energy while donned by the user whereby the therapeutic material may be heated selectively by the user without the need to remove the assistive device.

According to the methods hereof, therapy may be delivered by a user without need for medical assistance. In some embodiments, the assistive devices herein may be used to facilitate strategic delivery of either cold or heat to the top or bottom side of the hand. The thermal pads can be cooled in any freezer for cold application or placed in a microwave to provide heat. In use, typical application cycles of about 20 minutes are suitable for cold application, and can be repeated as often as needed, with 20-minute rest intervals. In some embodiments, heat may be applied continually. The assistive devices may be indicated for use as an adjunctive therapy for the hand and wrist after injury or surgery, and for management of arthritic symptoms. In exemplary embodiments, the assistive devices include flexible sleeves that are made with soft breathable cotton blends and tricot to keep skin dry and provide mild compression to help control or decrease swelling.

Significant benefits can be realized in connection with therapeutic use of the compression glove hereof, including but not limited to: optimized patient experience and outcome as a result of controlled and precise application of therapeutic treatment to the anatomy to reduce swelling and provide pain relief and possible reduced reliance on drug therapeutics. Unless otherwise indicated, all number expressing quantities, properties, and so forth as used in the specification and claims are to be understood as being modified in all instances by the term "about". Accordingly, unless otherwise indicated, the numerical properties set forth in the specification and claims are approximations that may vary depending on the suitable properties desired in embodiments of the present invention. Notwithstanding that any numerical ranges and parameters setting forth the broad scope of the general inventive concepts are approximations, numerical values set forth in the specific examples are reported as precisely as possible. Any numerical values, however, inherently contain certain errors necessarily resulting from error found in their respective measurements.

Certain constructions features are worthy of specific mention.

As visible perhaps best in FIG. 3, the glove 10 has a double fourchette seam along the lateral side of the glove completely around the glove. This forms a gusset like area which allows the glove 10 to easily accommodate the integrated non-removable pad 24.

Pad 24 is formed of a hot/cold gel as previously discussed, with the gel curing and forming a bond to its outer sleeve of covering material 28, which in turn is sewn along its side to the fourchette gusset. This allows an interior cavity for entry of hand on both sides of the integral pad 24. Thus, the glove is ambidextrous fitting either hand and pad 24 may be form fitted on either the volar or dorsal part of the hand.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts.

Those skilled in the art may readily adopt one or more of the inventive aspects, concepts, or features into additional embodiments and uses within the scope of the general invention concepts even if such embodiments are not expressly disclosed herein. Moreover, while various aspects, features, and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated. Further, while disclosed benefits, advantages, and solutions to problems have been described with reference to specific embodiments, these are not intended to be construed as essential or necessary to the invention.

What is claimed is:

1. A flexible ambidextrous compression glove sleeve, and at least one non-removable therapeutic pad adapted to fit within said compression glove sleeve;

the non-removeable therapeutic pad being contoured to fit at least a portion of an anatomical structure of the hand;

said non-removeable therapeutic pad being covered with a flexible and breathable material which can be non-removably attached to an inside of the compression glove sleeve in a manner to allow a hand to be inserted above or below the non-removeable therapeutic pad whether worn on the right hand or left hand.

2. The ambidextrous compression glove according to claim 1 wherein the compression glove sleeve slips over or is fitted and fastened to and closely conforms to the anatomy to be treated.

3. The ambidextrous compression glove of claim 1, wherein each of the at least one non-removable therapeutic pad comprises one or a combination of therapeutic materials selected from thermal energy storage phase change materials located to target areas of the hand.

4. The ambidextrous compression glove according to claim 1, wherein the flexible and breathable material is positioned adjacent to the compression glove sleeve for targeted treatment of at least one select anatomical structure of the hand selected from the group of wrist, hand, knuckles, and fingers.

5. An ambidextrous compression glove according to claim 1, wherein the at least one non-removable therapeutic pad comprises one or more retaining elements for retaining therapeutic material.

6. An anatomically contoured assistive device according to claim 1, further comprising a double fourchette seam and gusset along the lateral sides of the ambidextrous compression glove.

* * * * *